United States Patent [19]

Watts

[11] 3,959,089

[45] May 25, 1976

[54] SURFACE FINISHING AND PLATING METHOD

[76] Inventor: John D. Watts, 2 Mohawk Drive, Clinton, Conn. 06413

[22] Filed: Dec. 30, 1974

[21] Appl. No.: 537,079

Related U.S. Application Data

[62] Division of Ser. No. 276,882, July 31, 1972, Pat. No. 3,871,983.

[52] U.S. Cl. ..... 204/26; 204/35 R; 204/217

[51] Int. Cl.[2] ..... C25D 7/04; C25D 5/44

[58] Field of Search ..... 204/26, DIG. 10, 129.46, 204/217, 224 M, 35 R, 224 R

[56] References Cited

UNITED STATES PATENTS

| | | | |
|---|---|---|---|
| 2,997,437 | 8/1961 | Whitaker | 204/209 |
| 3,377,264 | 4/1968 | Duke et al. | 204/DIG. 10 |
| 3,616,289 | 10/1971 | Ellis et al. | 204/26 |
| 3,619,384 | 11/1971 | Eisner | 204/DIG. 10 |
| 3,706,650 | 12/1972 | Eisner | 204/DIG. 10 |
| 3,751,346 | 8/1973 | Ellis et al. | 204/26 |

*Primary Examiner*—T. M. Tufariello
*Attorney, Agent, or Firm*—DeLio and Montgomery

[57] ABSTRACT

This specification discloses a method and apparatus for plating a surface wherein a conductive anode body is spaced from a cathodic work surface by non-conductive particles carried in the anode body. The non-conductive particles closely space the anode from the cathodic surface, activate the cathodic surface to increase the plating rate, and may be utilized to carry out a honing or burnishing operation on the work surface.

7 Claims, 7 Drawing Figures

18
38
10
20
45b
16a
19
50
47
50a
46
47
45
36
17
45a
PS
POWER SUPPLY
21
22
16
24
32
23
33
37
25
61
26
30
31
27
16b
29
28
56
34
35
Z
41
40
Z
58
14
15
43
42
45
48a
49
15
14
13
12
60
P
62

SURFACE FINISHING AND PLATING METHOD

This is a division of application Ser. No. 276,882, filed July 31, 1972, now U.S. Pat. No. 3,871,983.

This invention relates to surface finishing apparatus and method, and more particularly relates to an apparatus and method operating upon a surface to apply a plating thereon.

Plating of a surface has customarily been accomplished by immersing the surface to be plated in an electrolyte and establishing an electrical potential between the workpiece and an electrode to produce migration of the plating ions in the solution to the workpiece and subsequent plating out thereon. As described above, this is a fairly time consuming process.

Recently, higher plating rates have been achieved by rubbing or abrading the electro deposit surface during the plating operation. Various theories for this phenomena have been expressed. One is that the electro deposit surface is activated to generate surface defect sites by mechanically distorting the crystal lattice of the metal deposited. Another is the decrease in a stagnant polarization layer overlying the cathodic surface. Generally speaking, the object of this activation of the surface is to increase the current density between the anode and the cathodic surface, resulting in a more rapid rate of deposition of the plating.

It has been proposed to burnish or hone a surface and provide plating thereon simultaneously or in the same overall process. One recently publicized technique in this area utilizes a procedure of mechanical abrading or honing to clean the metallic surface of a workpiece, with an arbor carrying abrading stones. Then the arbor is charged with an electrical potential opposite to a potential placed on the workpiece and an electrolytic solution is flooded between the arbor and the workpiece. This will result in metal plate onto the surface at a rate depending on the solution being used, the current density, and other well known parameters. In this method, the honing stones may be maintained in a low pressure state while the plating is occurring to attempt to eliminate treeing of the plating particles.

The technique as described above decreases the time required for plating. However, certain difficulties are presented in this process. The elongated arbor carrying the honing elements generally extends beyond both ends of the bore and results in a plating buildup beyond the end of the bore. Additionally, it has been determined that the arbor itself deplates due to the potential thereon.

It has also been proposed to mechanically activate the entire surface of a workpiece with a non-conductive matrix carried on a moving anode across the cathodic work surface. This technique is stated to substantially increase the plating current density and thereby decrease the plating time. This technique, however, requires that the entire surface of the workpiece be activated. Additionally, the positioning of the non-conductive matrix between the anode and the workpiece increased the spacing therebetween.

Another technique suggests the use of a movable device which moves between the anode and cathode while activating the cathodic surface and acting as a transfer device for ions between the anode and cathode. This obviously requires additional mechanism, complete immersion of the workpiece in the electrolyte, and/or anodes of a size substantially greater than the surface to be plated.

While the foregoing techniques have been effective to increase the current density between anode and cathode, they have certain limitations. They require large anode areas, or ion transfer mechanisms which are greater than the surface area to be plated. This may result in an over-abundance of throwing power and resultant inability to apply a discrete electro deposit within predetermined areas.

Accordingly, the present invention provides a new and improved apparatus and method for depositing a plating material on a cathodic surface in which the plating area as well as the plating thickness may be very precisely controlled. The invention further requires only simplified apparatus in the practice thereof.

In the present invention, in one form thereof, non-conductive particles are distributed through and held in a conductive body, and the non-conductive particles are moved over the cathodic surface to provide activation thereof while positive potential is applied to the conductive body. Besides providing the necessarily hard activating particles and also acting as a hone, if desired, the non-conductive particles permit very close spacing of the anode to the cathode, resulting in higher current densities and further providing a more uniform current field distribution between the anode and cathode.

The invention further provides means for controlling the pressure of the non-conductive particles on the cathodic surface and provide both a surface finishing action, under higher pressure, and a lighter pressure when the non-conductive particles are only serving to activate the cathodic surface.

The use of the non-conductive particles bound in the conductive body, which serves as the anode, provides a further advantage in localizing the area of plating on a cathodic surface in that the field between the anode and the cathode is localized to the area of the cathode positioned next to the anode and there will be little, if any, tendency to plate outside of the geometrical limits of the anode or the area adjacent the path of movement thereof.

The dimension of the tool is made lesser than the corresponding dimension of the workpiece so that the quality or evenness of plating throughout the length of the workpiece may be better controlled through control of movement of the tools. During a plating operation, the non-conductive particles of the tools are allowed to provide a very minor rubbing action on the surface. This tends to prevent the objectionable "treeing" and further is believed to produce a uniform orientation of the ionic plating particles to provide a more adherent bond of the plate to the substrate.

To control the spacing between the anode and the cathode, the anode material may be chosen to deplate or disintegrate at a rate proportional to wear on the non-conductive particles.

An object of this invention is to provide a new and improved apparatus and method for finishing the surface of a workpiece.

Another object of this invention is to provide a new and improved method for plating the surface of a workpiece or a predetermined portion thereof in which the plating area may be very closely controlled.

A further object of the invention is to provide an operation for finishing and/or plating the surface of a workpiece which decreases the operational time required and provides a bond between the plating and the base metal which is as strong as the metals themselves.

A further object of this invention is to provide a method and apparatus for coating the surface of a workpiece in which the spacing between the anode and cathodic surface may be very closely controlled.

The feature of the invention which are believed to be novel are particularly pointed out and distinctly claimed in the concluding portion of the specification. The invention, however, both as to its organization, operation, apparatus and practice thereof, together with further objects and advantages thereof may best be appreciated by referring to the following detailed description taken in conjunction with the drawings wherein:

Figure 1:
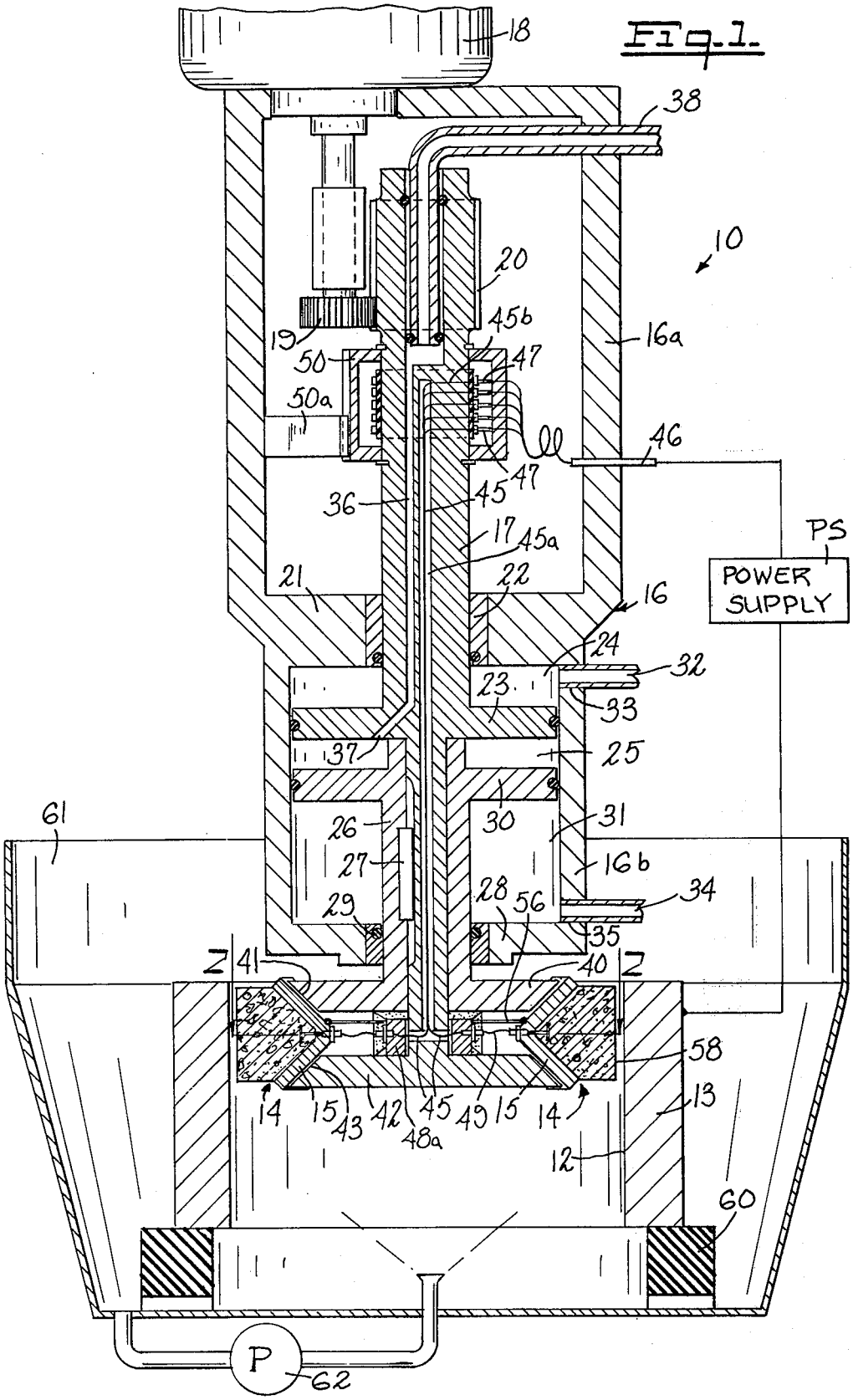
FIG. 1 is an elevation in half section of an apparatus utilized in the practice of the invention.
Figure 2:
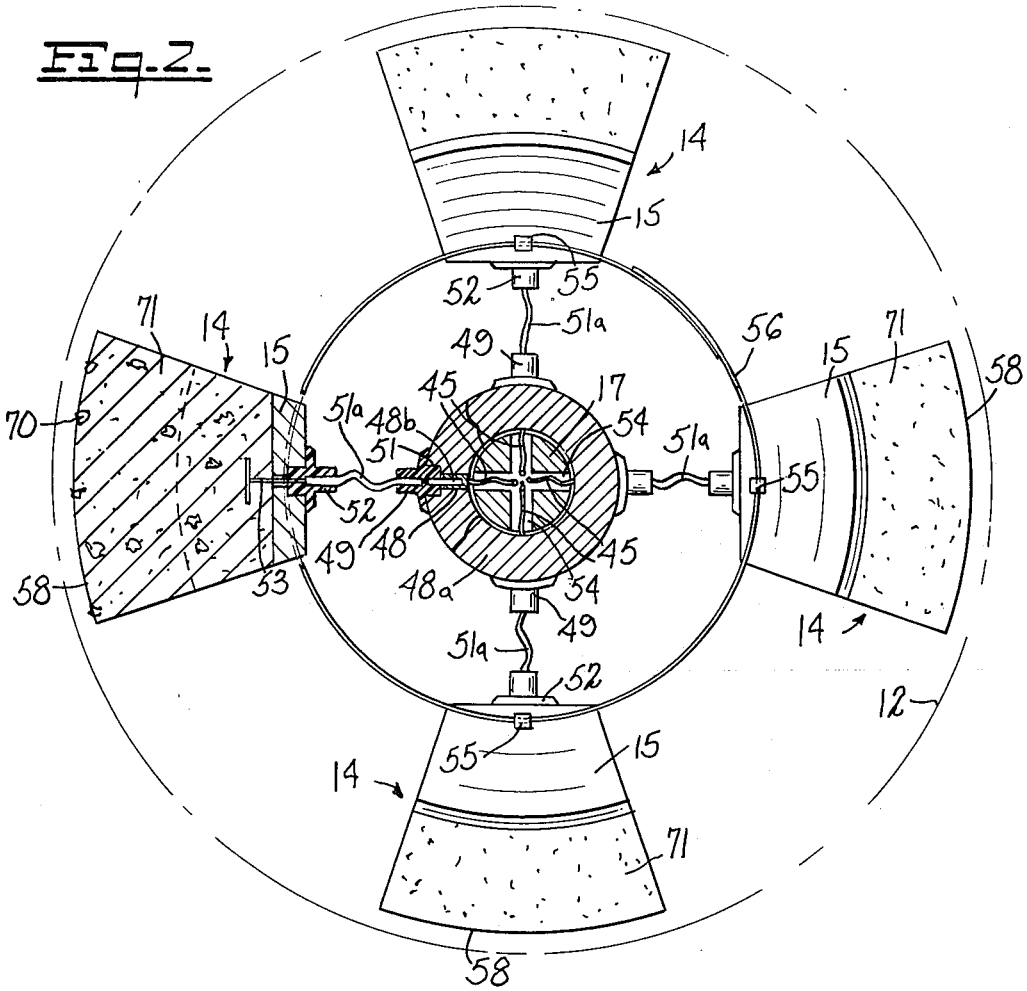
FIG. 2 is a view seen in the plane of lines 2—2 of FIG. 1.

As exemplified in FIG. 1, the invention may be embodied in an apparatus 10 adapted to finish and plate the cylindrical bore 12 of a workpiece 13. Acting on the bore 12 is a plurality of shoes or tools 14 comprising grains or particles of a non-conductive material uniformly distributed and bound together in a conductive body material. The tools 14 are carried in non-conductive holders or carriers 15 having tapered rear surfaces. The non-conductive particles may be aluminum oxide or other materials as hereinafter described.

The tools 14 are adapted to engage the surface bore 12 and wipe or activate the surface which is cathodic while a positive potential is applied to the conductive tool bodies as hereinafter described.

Apparatus 10 further comprises a housing member 16 having an upper portion 16a and a lower portion 16b. A shaft 17 is rotatably mounted in housing 10 and is adapted to be driven by a motor 18 with a pinion 19 on the shaft thereof engaging a spline-like gear 20 on shaft 17. This connection permits vertical movement of shaft 17 with respect to gear 20. Shaft 17 extends through a wall 21 carrying a bearing seal 22 into the lower portion 16b of the housing member and has integral therewith or attached thereto a piston 23 which, together with wall 21 defines a cylinder or chamber 24.

A piston member 26 is coaxial about shaft 17 and non-rotatably mounted thereto as by means of a key 27. Shaft 17 in piston member 26 extends coaxially through a bottom wall 28 and a bearing seal 29. Wall 28 together with piston portion 30 of member 26 define a cylinder or chamber 31.

As hereinafter described, the various parts may be actuated either pneumatically or hydraulically. A fluid conduit 32 extends to a port 33 in housing portion 16b to communicate with chamber 24. A fluid conduit 34 also extends through housing 16b at a port 35 to provide communication to the inside of chamber 31. A passage 36 extending longitudinally of shaft 17 communicates through a port 37 with chamber 25 and at the upper end of shaft 17 is in communication with a suitably sealed fluid conduit 38. Extending radially outwardly from member 26 below wall 28 is a pressure member 40 having a tapered peripheral surface 41 adapted to act on tapered carriers 15. A second pressure member 42 extends radially from the end of shaft 17 and has tapered surface 43 also engaging the tapered surface of holders 15. Thus when the member 40 is moved downwardly toward member 42 as by increasing the pressure in chamber 25 due to delivery of fluid through passage 36 and port 37 the tapered surfaces 41 and 43 acting on the tapered holders 15 force the shoes 14 outwardly toward contact with cylindrical bore 12 to increase the pressure of the bodies 14 on the surface 12. The bodies 14 may be moved downwardly with respect to bore 12 by increasing the pressure in chamber 24 and simultaneously decreasing the pressure in chamber 31. The bodies 14 are moved upwardly by increasing the pressure in chamber 31 while decreasing the pressure in chamber 24. The members 40 and 42 thus provide a means for increasing the pressure of the non-conductive particles of the anode bodies on the cathodic surface.

As these pressure changes are alternated, the bodies 14 may be reciprocated within the confines of bore 12. Simultaneously with such reciprocation, the bodies 14 may be rotationally moved by motor 18 acting through pinion 19 on gear 20 on shaft 17. With this arrangement, the bodies 14 may have both revolving and reciprocatory motion imparted thereto. Electrical power is delivered to bodies 14 through an insulated conductor 45 extending through a passage or bore **45*a* in shaft 17 and connected to the bodies 14 as hereinafter described. Electrical power may be applied to conductor 45 through a lead 46 extending through housing portion 16a to one or more brushes 47 bearing on a conductive ring about shaft 17 and suitably insulated therefrom. Leads 45b are taken to conductor or conductors 45. This slip-ring arrangement is contained within a housing 50 non-rotatably disposed with respect to shaft 17 and mounted for vertical movement on support member 50a extending from the inner side wall of housing portion 16a.**

For reasons hereinafter made apparent, the housing 16, the portion of shaft 17 extending therefrom, and pressure members 40 and 42 have an electrical insulating surface coating which may comprise a layer of a polyethylene or a polypropylene. The purpose of such insulating layer is to prevent any anodic or cathodic action on or by these parts.

The conductors 45 are brought through passage 45c and connected to bodies 14 in any suitable manner. For example, the conductors 45 may be connected to female connectors 48 carried in an insulating block or collar 48a disposed about shaft 17 just above member 42, as more clearly seen in FIG. 1. The connectors 48 receive a male connector 48b carried by an insulating terminal member 49 received in a recess 51 in collar 48a. A flexible insulated connector 51a suitably extends into an insulating terminal 52 which engages a conductive member 53 in carrier 15 and body 14 to complete an electrical connection to the conductive body 14. If desired, the conductor 53 may have a headed or flanged end to increase the area of contact with the material of body 14. The lower end of shaft 17 has radial passages 54 defined therein for leading the conductors 45 to terminals 48b. The connection between the insulating terminal members 52 and 49 is by a somewhat flexible cable or conductor 51 to permit inward and outward movement of the bodies 14.

With the arrangement described, the connecting portion may be disconnected both from terminal 49 and the terminal 52 in body 14 and/or the conductor 53 in body 14 to permit replacement of the body as desired. The holders 15 may be provided with an eye 55 thereon through which extends an annular resilient strip 56 which acts as a retainer on the body 14 but which permits radial outward movement of the bodies 14 due to pressure exerted thereon by members 40 and 42. Strip 56 will permit outward movement of bodies 14 due to centrifugal force so that the surfaces 58 thereof may ride lightly on the bore 12 of workpiece 13 without the application of positive pressure. Strip 56 has sufficient resiliency to retract bodies 14 when a cycle of operation is complete and allow removal of the bodies from bore 12. The housing member 16 may be mounted to a column or to a pair of vertical guides (not shown) for vertical positioning.

The workpiece 13 is carried on a support member 60 within a receptacle 61. Support 60 is suitably insulated or formed of a material which will not be subject to electrolytic action. An electrolyte is moved upwardly through bore 12 under pressure from pump 62 to flood the space between bodies 14 and bore 12. As the electrolyte overflows bore 12 it is retained in receptacle 61 and recycled by pump 62. Any suitable technique may be utilized to supply the electrolyte between the anode bodies 14 and bore 12. The foregoing technique is merely exemplary.

Figure 3:
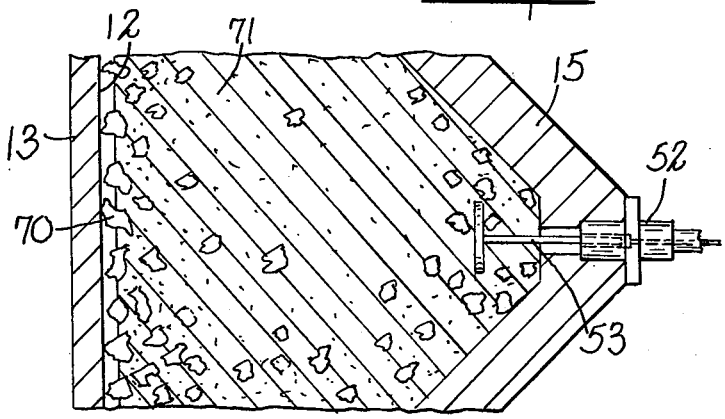
FIG. 3 is an enlarged view of a portion of FIG. 1.

The bodies 14 (FIG. 3) are composed of non-conductive particles 70 uniformly dispersed and distributed through the conductive body material 71. The particles 70 may have a multiple function. They serve to space the anode, body material 71 from the work surface 12, act as honing stones, to finish surface 12, and also mechanically activate the surface 12 and any plating deposit thereon.

The size of the particles is preferably 50 to 80 mesh grit for most applications. This could provide a cathode to anode spacing of 0.0005 to 0.050 inch plus. Where the surface 12 is unusually rough a larger size particle may be used to increase the spacing between anode and cathode. The particle size may also vary outside of the foregoing range dependent on the particular application and whether more or less abrading is desired, and the roughness of the surface to be plated.

The bodies 14 may be copper containing 25 –75 percent by volume of aluminum oxide particles which are stirred into a copper in a molten state to achieve uniform distribution, and cast into the shape shown. Other solid metals as well as alloys thereof may form the anode bodies 14 as hereinafter explained.

Another body composition may be formed from a wet slurry of carbon particles and aluminum oxide particles which are stirred, as by vibration, while subjected to heat. The resulting mixture is dried into a hard dry body 14 comprising uniformly distributed non-conducting abrasive particles in the conductive body.

In this construction, the surface carbon would tend to break down as the non-conductive particles wore and dropped out of the body. This would maintain the spacing between the anode body and the work surface.

In the first-mentioned constructions where the body is a cast metal, an unobvious use is made of a normally undesirable problem. Normally, in abrasive plating, as mentioned in the introductory portion of this specification, the anode deplates or deteriorates and may change the spacing with respect to the cathodic surface. However, in the present invention, the anode material is selected so that if it is subject to deplating, it will deplate or disintegrate at a controlled rate proportional to wear of the non-conductive spacing particles.

Therefore, the anode metal, and/or alloys thereof, is selected with respect to the type of plate according to the properties of the metal and the electromotive series. For example, a titanium oxide anode would be used for gold plate. The oxides of titanium are very resistant to deplating and more noble than silver in the electromotive series. Nickel could be used as the anode in plating copper; cobalt for plating nickel; steel for plating cadmium; aluminum alloys for plating zinc or chrome.

In some instances a semi-conductor such as silicon carbide may be used for the particles 70. Because of the relatively low voltage applied across the electrodes, such particles would act as non-conductors or semi-conductors for special effect plating.

In the embodiment thus far exemplified, there will be a cyclic application of the positive anode potential as bodies 14 rotate past a given area on the walls 12 of the bore. This effect provides a tighter bond between the plate and the base metal. This is believed to be due to the moving anode orienting and re-orienting the plating ions to uniform positions on the surface of the work.

It is apparent that the area of the moving anodes is less than the area of the surface to be plated. Thus, plating can be more accurately controlled to the area adjacent the anodes. Due to this relationship there will be no overruns of plating material at the ends of the bores, or outside of the boundaries of the anodes.

Figure 4:
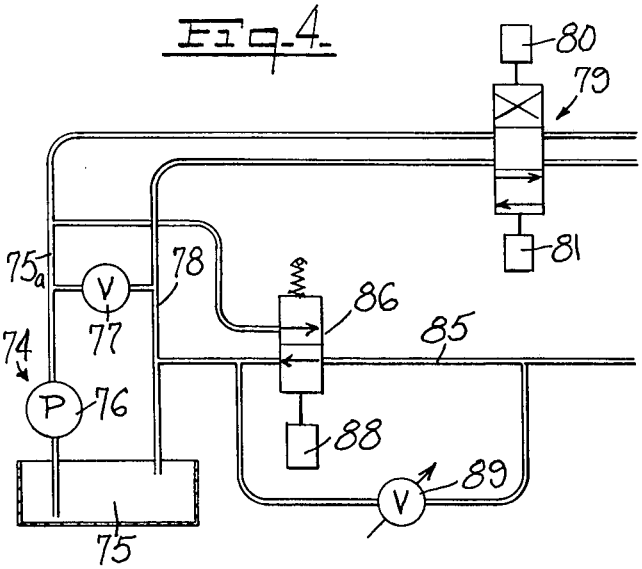
FIGS. 4 and 5 are schematic fluid and electrical diagrams exemplifying control of movements of the device of FIG. 1.

FIG. 4 exemplifies a basic diagram for controlling vertical movement of the anode bodies 14 of the apparatus of FIG. 1. A hydraulic system 74 comprises a fluid reservoir 75, a pump 76 supplying fluid under pressure to a line **75*a* and a pressure relief or regulating valve 77, connected between pressure line 75*a* and return line 78. Line 75*a* may be connected to chambers 25 or 31 through their respective ports 33 and 35 by a four-way valve 79 operated by solenoids 80 and 81. If solenoid 80 is actuated, as by closing switch 82, line 75 is connected to chamber 24 through port 33 and chamber 31 is connected to return line 78. This will produce downward movement of bodies 14 while shaft 19** is rotated.

Figure 5:
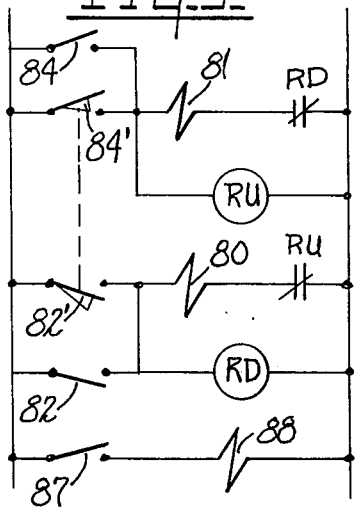

To move bodies 14 upwardly, solenoid 81 is energized by closing switch 84 and the connections of lines **75*a* and 78 to ports 33 and 35 are reversed. Solenoids 80 and 81 are interlocked through relays RD and RU as shown in FIG. 5.** Each of relays is in parallel with one solenoid and has a normally closed contact in series with the other.

Fluid pressure is applied to chamber 25 through line 85 and two-way valve 86 when a switch 87 is closed to energize valve-solenoid 88. A variable pressure regulator valve 89 is connected across valve 86 to establish a predetermined pressure in chamber 25 and, hence, control the pressure of bodies 14 on wall 12. Valve 89 will be set so that the pressure in chamber 25 is no less than the pressure in one of chambers 24 or 31 during vertical movement. Pressure in chamber 25 may be reduced for a plating operation by lowering the setting of valve 89.

For automatic operation, the switches 82' and 84' may be provided to operate as reversing limit switches within housing **16*a* on member 50 and operated by positionable dogs (not shown) in housing 16*a*.** The position of the switches and dogs will determine the dimension of vertical travel.

The fluid control circuit exemplified in FIG. 4 may include various throttling and flow control devices to predetermine the rate of vertical movement, and reciprocation of bodies 14.

In operation, shaft 17 is rotated by motor 18. If no pressure is applied to member 15, the bodies 14 will move outwardly due to centrifugal force and rub lightly on the cathodic surface to produce mechanical activation thereof. For plating purposes a positive potential is applied to lead 46 and a negative potential applied to the workpiece from a power supply exemplified as PS, FIG. 1.

Where a finishing operation is desired, hydraulic fluid is introduced through line 38 to chamber 25, piston member 26 is urged downwardly and bodies 14 urged outwardly until a predetermined pressure is established between the bodies 14 and bore 12. Then a honing or finishing operation may be performed, either before or after a plating cycle.

The foregoing FIGS. 4 and 5 are intended only to exemplify control of the movements of the anode bodies. In a production set-up, as for repetitive operation on the same type of workpieces, programmed automatic cycling controls of a suitable type may be employed.

Figure 6:
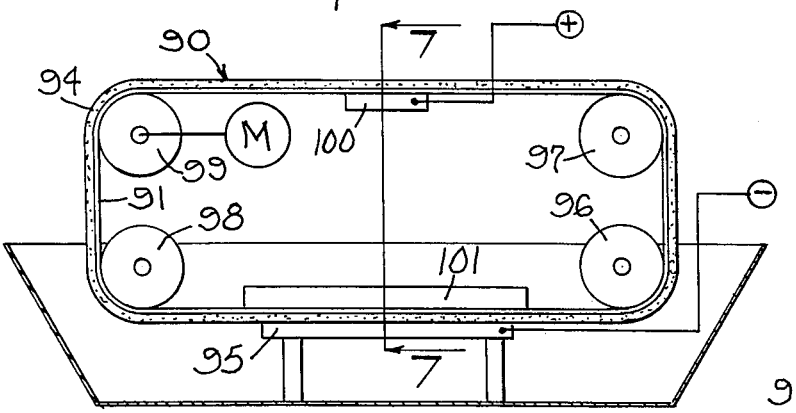
FIG. 6 is a side elevation of another device for practicing the invention.
Figure 7:
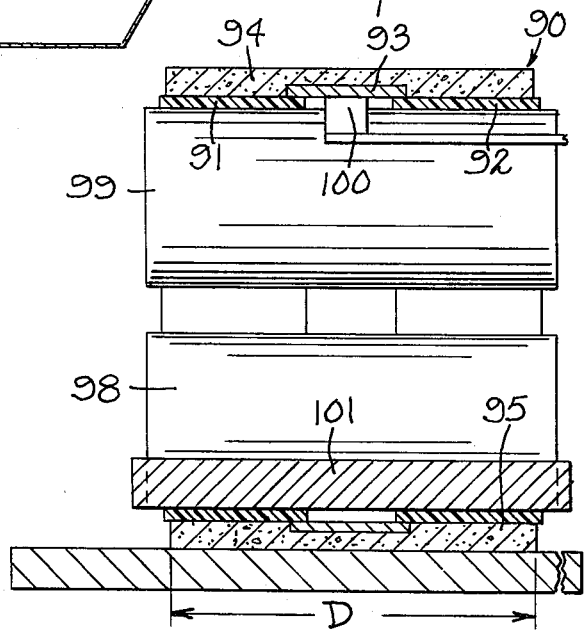
FIG. 7 is a view seen in the plane of lines 7—7 of FIG. 6.

The invention may also be practiced in other forms. FIGS. 6 and 7 exemplify apparatus and technique for plating a small portion of a substrate. Such an application might include plating small areas of gold or copper electrical contacts.

An endless belt 90 comprising spaced apart flexible members 91 and 92 with the spacing spanned by a conductor 93 is provided. One surface of the belt is covered by a layer of conductive material 94 bonded to members 91, 92 and 93. The material includes non-conductive hard particles which closely space the conductive body from a cathodic workpiece 95.

The belt 90 is passed over non-conductive idler rolls or shafts 96, 97, 98 and 99 which may be adjustable to tension belt 90, and to change the outline defined by the belt. Roll 99 is driven by a motor M to move belt 90 over a particular portion of workpiece 95. The close proximity of the anode belt to the cathodic surface permits greater control of the electro deposit on a local or selected area D with no deleterious fringe effects at the edges. The anode belt is connected to a positive potential through a brush 100 bearing on conductor 93, or other suitable coupling device.

The belt, as shown, comprises flexible backing members together with a conductive strip covered by a conductive material with the non-conductive abrasive members therein.

The belt may also be formed of a conductive ionomer plastic. A zinc or sodium substituted radical of polyethylene may be comminuted, mixed with other conductive particles such as graphite, aluminum, copper, etc., and the non-conductive particles, heated and extruded into belt form. If desired, glass fibers may be included in the blend to impart strength and control the degree of flexibility. In such cases the conductive strip 93 may not be required. A suitable ionomer is one sold under the trademark Surlyn by E. I. DuPont DeNemours Company.

The belt may also be constructed from woven metal fibers, such as titanium or copper, impregnated with conductive material and non-conductive particles. The belt may also be constructed of a woven non-metal fiber impregnated with a mixture of conductive and non-conductive particles, then calendered or otherwise formed.

In most cases, the belt need be no thicker than one-fourth to three-eighth inch. This dimension will permit sufficient flexibility of the belt.

A platen 101 is provided to control the pressure of the belt 90 on the workpiece. Platen 101 may be controlled by one or more hydraulic or pneumatic cylinders (not shown) to vary the pressure on the workpiece.

The anode bodies may take many different geometrical shapes depending on the surface to be finished or plated For a flat surface, a horizontal disc or wheel may be provided. A bore may also be plated through use of a rotating anode which is also revolved about the axis of the bore. In such applications, the electrolyte may be directed at the areas of contact of the anode tool on the work surface by one or more nozzles.

The non-conductive particles in the anode bodies 14 or the belt 90 or other anode tool may have a selected hardness which is determined by the breakdown or deplating rate of the conductive body material, and if a grinding or honing operation is desired, either before or after plating. Generally, the plating rate will be enhanced with softer, finer non-conductive abrasive particles. other determining considerations are the degree of hardness of the applied plating material, plating rate, and surface finish desired.

The close, uniform spacing of the anode to cathode over the area to be placted is an important feature of the invention. Theoretically, such spacing could be as small as one molecule. However, a range of 0.040 for plating on relatively rough finished surfaces to as little as 0.0005 inch is the preferred range. This decreases the flow path between anode and cathode and permits the plating ions to adhere to the cathodic surface before any physical changes such as oxidation or dissipation of static charges occur. It also eliminates the undesirable treeing effect and tends to uniformly orient the plating ions on the cathodic surface. This provides a more adherent band of the ions to the cathodic surface.

In all cases the electrolyte contains the ions of the metal to be plated on the substrate of dissimilar metal. The moving anode bodies continuously move a fresh supply of ions along the surface to be plated.

It may thus be seen that the objects of the invention set forth as well as those made apparent from the foregoing disclosure are efficiently attained. Modifications to the disclosed embodiments of the invention as well as other embodiments thereof may occur to others skilled in the art. Accordingly, the appended claims are intended to cover all modifications to the disclosed embodiments as well as other embodiments thereof which do not depart from the spirit and scope of the invention.

What is claimed is:

1. A method of operating upon the surface of a workpiece comprising the steps of providing a tool comprising a plurality of non-conductive relatively hard particles bound and uniformly distributed in at least one electrically conductive body, relatively moving said tool with respect to the surface of the workpiece such that the particles engage said surface and space said conductive body from said surface, supplying an electrolytic solution between said body and the surface, and applying a positive electric potential to said body with respect to an electrical potential applied to the workpiece.

2. The method of claim 1 including the further step of controlling the pressure between the body and the workpiece.

3. A method of operating upon the surface of a workpiece to produce a plating thereon of a dissimilar metal which is of lesser area than the surface of the workpiece comprising the steps of providing an elongated flexible member comprising a plurality of non-conductive abrasive particles bound and distributed uniformly in an electrically conductive body, moving said member with respect to the surface of the workpiece along a path to be plated such that the particles engage the surface and space said surface from said conductive body, supplying an electrolytic solution containing ions of the metal to be plated between said matrix and the surface, and applying a positive electric potential to said body with respect to an electrical potential applied to the workpiece.

4. The method of claim 3 including the further step of controlling the presure of the belt on the workpiece.

5. The method of claim 1 wherein said body is flexible.

6. The method of claim 3 including the further step of controlling the pressure between said body and the workpiece.

7. The method of claim 1 wherein the material of said body is selected with respect to the workpiece such that as said particles wear and said anode dissolves during electrolytic plating the particles maintain a substantially constant spacing between said body and the workpiece.

* * * * *